US005768741A

United States Patent [19]

Leiman et al.

[11] Patent Number: 5,768,741

[45] Date of Patent: Jun. 23, 1998

[54] FLEXIBLE PIPE CLEANING DEVICE AND SYSTEM

[76] Inventors: Basil C. Leiman, P.O.Box 79711, Houston, Tex. 77279; Bruce D. Butler, 1609 Milford, Houston, Tex. 77006

[21] Appl. No.: 720,351

[22] Filed: Sep. 27, 1996

[51] Int. Cl.[6] ..... B08B 9/00

[52] U.S. Cl. ..... 15/304; 15/104.05; 15/104.95; 15/104.16; 15/395

[58] Field of Search ..... 15/104.05, 104.09, 15/104.095, 104.096, 104.13, 104.16, 104.33, 304, 395

[56] References Cited

U.S. PATENT DOCUMENTS

| | | | |
|---|---|---|---|
| 1,402,786 | 1/1922 | Muehl | 15/104.095 |
| 2,125,864 | 8/1938 | Auckland | 15/104.09 |
| 2,447,869 | 8/1948 | Pearson et al. | 15/104.16 |
| 2,599,077 | 6/1952 | Sturgis | 15/104.09 |
| 4,244,072 | 1/1981 | Dunham et al. | 15/104.095 |
| 5,383,243 | 1/1995 | Thacker et al. | 15/104.05 |

OTHER PUBLICATIONS

Basic Plumbing, Sunset Books, 8,9, 28–32 (date unknown).
Home Plumbing Projects & Repairs, Black & Decker Home Improvement Library, 88,89 (Cy DeCosse Incorporated 1990).
Do Your Own Plumbing, Popular Science, 12, 43 (Popular Science Books 1987, reprinted in 1991 by Sterling Publishing Company, Inc.).

*Primary Examiner*—David Scherbel
*Assistant Examiner*—Terrence R. Till
*Attorney, Agent, or Firm*—Rosenblatt & Redano, P.C.

[57] ABSTRACT

This invention relates to a device and system for cleaning the interior of conduits, gun barrels, or pipes, including drain pipes. The pipe cleaning device of the present invention is capable of (a) penetrating and removing restrictions that block flow, (b) scouring the interior wall of conduits or pipes to remove the buildup of undesirable solids that result in flow restriction, and (c) coating the wall of the pipe with a suitable substance. The present invention comprises a connecting member housed within a bendable or flexible conduit, a retraction handle attached to one end of the connecting member, and elastic or flexible strands attached to the opposite end of said connecting member. The strands are outwardly expandable in a radial dimension when said connecting member is retracted. The system of the present invention further comprises a pressure/suction source coupled to the conduit.

20 Claims, 2 Drawing Sheets

FLEXIBLE PIPE CLEANING DEVICE AND SYSTEM

BACKGROUND OF THE INVENTION

1. Field of the Invention

This invention relates to a device and system for cleaning the interior of conduits, pipes, or gun barrels including drain pipes. The pipe cleaning device of the present invention is capable of both (a) penetrating and removing restrictions that block flow, (b) scouring the interior wall of conduits or pipes to remove the buildup of undesirable solids that result in flow restriction, and (c) coating the wall of the pipe with a suitable substance. The present invention comprises a connecting member housed within a bendable or flexible conduit, a retraction handle attached to one end of the connecting member, and elastic or flexible strands attached to the opposite end of said connecting member. The strands are outwardly expandable in a radial dimension when said connecting member is retracted. The system of the present invention further comprises a pressure/suction source coupled to the conduit.

2. Description of the Prior Art

The presence of solids in pipes intended to permit fluid flow can lead to flow restriction or blockage that is undesirable. In drain pipes such blockage often results from solids or other particulate matter entering the pipes through a drain opening. Three methods employed by the prior art for cleaning clogged or blocked pipes involve the use of chemical cleaners intended to dissolve flow restrictions, pressurized fluids, and the use of mechanical cleaning devices, known as augers or plungers.

Chemical cleaners often use liquids that are strong acids or strong bases. Such liquids can cause corrosive damage to metallic pipes or result in severe injury if they come in contact with exposed portions of the human body, or if they are ingested. Such cleaners are particularly dangerous in households with young children. Pressurized fluid methods can also result in the splashing of liquids on the operator, thereby causing bodily harm to the operator.

Prior art augers comprise a bendable or flexible member coupled to a penetrating member that is attached to the distal end and rotatable handle attached to the proximal end. Prior art augers are designed to be inserted into a clogged pipe to the point that the penetrating member contacts the flow blockage. The handle is then rotated to cause the flexible member to rotate. Such rotational motion facilitates the penetration or drilling of the flow blockage by the penetrating member.

Prior art augers function to remove blockages that substantially block the cross sectional flow area of a pipe or conduit. One of the many drawbacks of prior art augers is that they have little utility in reducing or cleaning the buildup of impurities on the inner walls of pipes or conduits. Such impurities serve as flow restrictors and may eventually result in total flow blockage if allowed to continue to propagate.

The present invention overcomes the drawbacks and limitations of prior art augers by providing a device that can both (a) remove flow blockages that block the cross sectional area of a flow path, and (b) scour the inner wall of flow paths to remove the buildup of impurities, or other undesirable material. The present invention also provides for easy reciprocating operation that can be accomplished using minimal finger movement. The present invention overcomes the drawbacks of chemical cleaners by providing a pipe cleaning device that is not environmentally hazardous or poisonous.

The present invention offers several additional advantages over the prior art. It pulls plugs or flow restrictions apart, allowing breakup of the restrictions. It is capable of grabbing all or portions of a plug or restriction in order to remove it. The present invention further utilizes intermittent or constant expansion and contraction action of elastic strands to disrupt the integrity of a plug or a flow restriction. The present invention enables a coating material to be applied to the inner surface of a conduit, gun barrel, or pipe.

SUMMARY OF THE INVENTION

The present invention is directed toward a device and system for cleaning the interior of conduits, gun barrels, or pipes, including drain pipes. The device embodiment of the present invention comprises a flexible conduit having a proximal end and a distal end, a flexible connecting member slidably housed within the conduit, at least two elastic strands having proximal and distal ends, and a retraction handle attached to the proximal end of the connecting member such that pushing and pulling the handle results in a reciprocating motion of the connecting member. The connecting member comprises a proximal connecting end protruding beyond the proximal end of the conduit and a distal connecting end protruding beyond the distal end of the conduit.

The proximal end of each elastic strand is attached to the distal end of the conduit such that when the conduit is rotated, the strands also rotate. The distal end of the strands are fastened to the distal end of the connecting member such that when the connecting member is retracted, the strands are displaced outward and when the connecting member is not retracted, the strands are displaced in a substantially close configuration with respect to each other.

The system embodiment of the present invention comprises the elements of the device embodiment, discussed above, plus a pressure/suction source coupled to the proximal end of the conduit. The pressure/suction source is capable of either injecting pressurized fluid into the conduit or creating a pressure or suction in the conduit.

The present invention may be used to break up a flow restriction into smaller pieces. The injection of pressurized fluid can then be used to dissolve or blow the smaller pieces away. Alternatively, the suction source that can be used with the system embodiment of the present invention can be used to suck the smaller pieces out of the pipe or conduit.

DETAILED DESCRIPTION OF THE PREFERRED EMBODIMENT

Figure 1A:
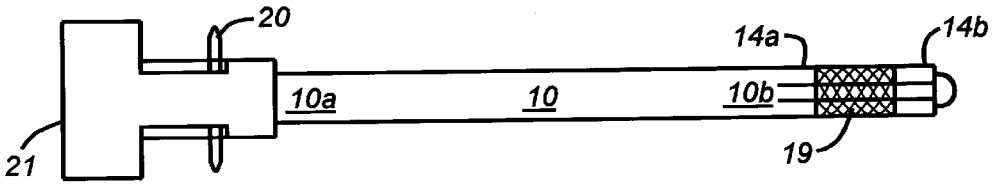
FIG. 1*a* is a side view of the device embodiment of the present invention comprising an expandable covering around the strands.
Figure 1B:
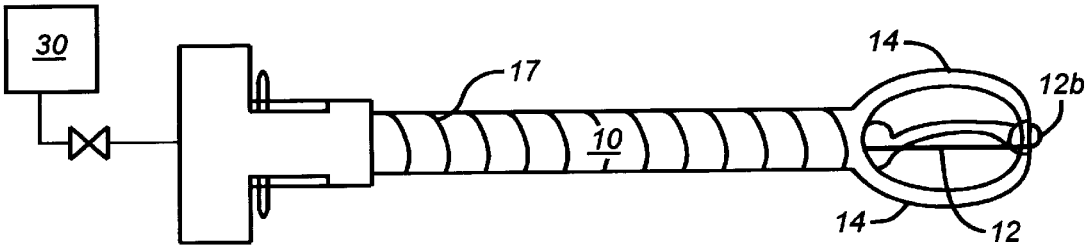
FIG. 1*b* is a side view of a system embodiment of the present invention with a conduit comprising reinforcing material.

As shown in FIGS. 1*a* and 1*b*, the present invention is directed toward a pipe cleaning device comprising a flexible conduit 10 having a proximal end 10*a* and a distal end 10*b*. In a preferred embodiment, the conduit 10 comprises reinforcing material 17 integrally housed within the conduit, as shown in FIG. 1*b*. The reinforcing member may be wire or string.

Figure 1C:
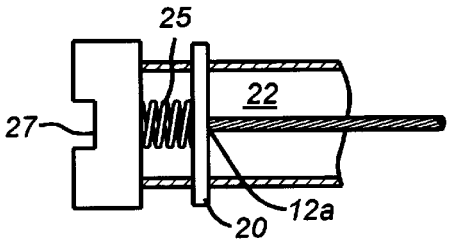
FIG. 1*c* is a side cutaway view of the retraction handle of the present invention.

The invention further comprises a flexible connecting member 12 slidably housed within the conduit. The connecting member comprises a proximal connecting end 12*a* protruding beyond the proximal end of the conduit. It further comprises a distal connecting end 12*b* protruding beyond the distal end of the conduit. In a preferred embodiment, the connecting member 12 is a cable, as shown in FIG. 1*c*. The connecting member may also be a wire, as shown in FIG. 1*b*. In preferred embodiments, the distal end of the connecting member is shaped in a J-hook or loop configuration to facilitate passage of the present invention in pipes having curves or bends.

The invention further comprises at least two elastic strands 14 having proximal and distal ends. The proximal end of each strand 14*a* is attached to the distal end of the conduit such that when the conduit is rotated, the strands rotate. The distal ends of each strand 14*b* is fastened to the distal end of the connecting member such that when the connecting member is retracted, strands are bowed or displaced outward, as shown in FIG. 1*b*. The strands are further connected to the distal end of the connecting member such that when the connecting member is not retracted, the strands are displaced in a substantially closed or nonbowed configuration with respect to each other, as shown in FIG. 1*a*. In a preferred embodiment, as shown in FIG. 1*a*, the strands are integrally formed with the conduit. In another preferred embodiment, the strands comprise a reinforcing material 23 integrally housed within said strands.

Figure 2A:
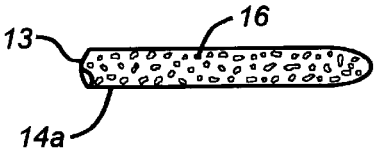
FIG. 2*a* is a top view of an outer surface of the strand comprising abrasive material.
Figure 2B:
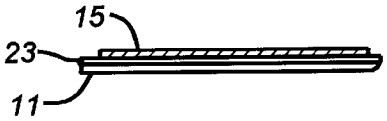
FIG. 2*b* is a side view of a strand comprising absorbent material.

As shown in FIGS. 2*a* and 2*b*, the strands comprise an outer radial surface 13 and an inner radial surface 11. In a preferred embodiment, the outer surface of the strands comprise a fluid absorbent member 15. In another preferred embodiment, the strands are ribbon shaped, as shown in FIG. 2*a*. In another preferred embodiment, the outer surface of the strands comprises an abrasive material 16. Such abrasive material enables the invention to grind away the buildup of impurities on the inner walls of conduits, gun barrels, or pipes within which the invention is used. This grinding action can be accomplished by either reciprocating the handle of the invention or by rotating the invention within the conduit when the handle is retracted. In another preferred embodiment, the strands are surrounded by an expandable covering 19 that may be absorbent or abrasive, as shown in FIG. 1*a*. Where the expandable covering is made from absorbent material, such absorbent material enables the invention, to apply suitable material to dissolve or otherwise remove impurities which are built up on the inner walls of conduits, gun barrels, or pipes. Such absorbent material also enables the invention to apply suitable coating material such as lubricants or protective agents on the inner walls of conduits, gun barrels or pipes. In a preferred embodiment, the expandable covering may be a sock secured to said strands by Velcro® or a purse string.

In another preferred embodiment, the strands are made from a material that is detectable by x-rays or by ultrasound energy. Such material construction allows for a determination of the exact position of the strands within a pipe or conduit, using either an external source of x-rays or ultrasound energy.

The invention further comprises a retraction handle 20 attached to the proximal end of the connecting member such that pushing and pulling the handle results in a reciprocating motion of the connecting member, as shown in FIGS. 1*a* and 1*b*. In a preferred embodiment, the retraction handle comprises an outer housing 21 sized to fit within the palm of an adult human hand. The retraction handle further comprises an inner cavity 22 within the outer housing. The inner cavity is sized to permit reciprocating movement of the handle 21 and connecting member 12 within the cavity, as shown in FIG. 1*c*. In a preferred embodiment, the retraction handle is attached to the connecting member located within the inner cavity. The retraction handle protrudes beyond the outer housing such that its protruding portion may be pushed or pulled by one or more fingers of an adult human hand, as shown in FIGS. 1*a*–1*c*.

In a preferred embodiment, an elastic compression resistance member 25 is installed in the inner cavity of the retraction handle and mechanically coupled to the retraction handle to provide a restoring force capable of restoring the retraction handle to a position where the connecting member is not retracted when the retraction handle is not subject to external force, as shown in FIG. 1*c*. In a preferred embodiment, the compression resistance member is a spring 25, as shown in FIG. 1*c*. In another preferred embodiment, the retraction handle encompasses a pistol grip like action.

In a preferred embodiment, the retraction handle comprises a coupling receptacle 27 mounted in the top of the outer housing 21 such that the outer housing can be coupled to a rotational motion device, such as a drill.

In another preferred embodiment, the retraction handle is an elastic ribbon-like member formed in the shape of an ellipse and joined at each end to the conduit. The proximal end of the connection member is affixed to this retraction handle at a point furthest from the proximal end of the conduit, such that when the ribbon-like retraction handle is squeezed, the point where the connecting member is attached is moved further away from the proximal end of the conduit, thereby retracting the connecting member. When the squeezing of the ribbon-like retraction handle is stopped, the connecting member is returned to its unretracted position.

The device embodiment of the present invention may also be coupled with a pressure/suction source to produce a system embodiment of the present invention. In its system embodiment, the present invention comprises the elements described above. Additionally, the present invention comprises a pressure/suction source 30, coupled to the proximal end of the conduit, as shown in FIG. 1*b*. The pressure/suction source is capable of either injecting pressurized fluid into the conduit or creating a pressure or suction in the conduit. Such pressure or suction is transmitted to the pipe, gun barrel, or drain pipe.

Figure 3A:
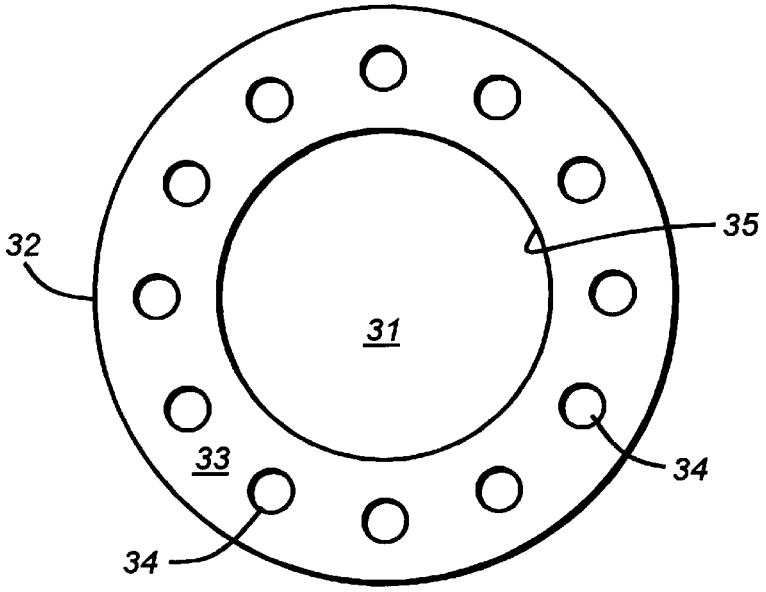
FIG. 3*a* is a top view of the strainer cap of the present invention.
Figure 3B:
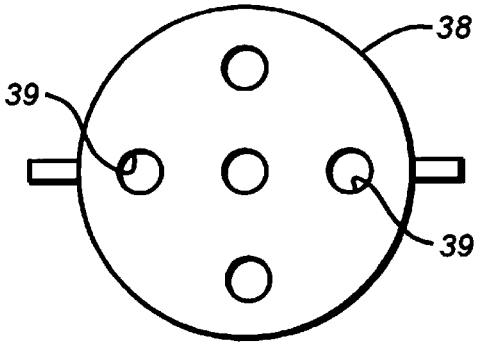
FIG. 3*b* is a top view of the central insert for the strainer cap of the present invention.
Figure 3C:
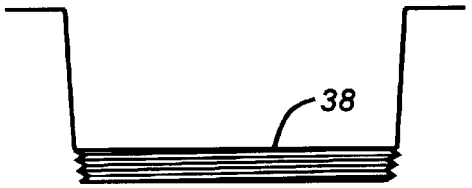
FIG. 3*c* is a side view of the central insert for the strainer cap of the present invention.

The present invention, in either its device or system embodiment, may be used in conjunction with a customized drain cap, of the type shown in FIGS. 3*a*–3*c*. Such a cap permits the present invention to be easily inserted into a pipe or conduit to be cleaned, such as the drain pipe of a sink.

The circular drain strainer cap 32 of the present invention is shown in FIG. 3*a*. This strainer cap comprises an outer radial region 33 and an inner radial region 31. The outer radial region comprises one or more drain holes 34. The inner radial region comprises a central opening 35, sized to permit insertion and passage of the strands and conduit of the present invention.

When the circular drain strainer cap is not being used in conjunction with the pipe cleaning device of the present invention, its inner radial region can be used for normal draining and straining purposes by using the central insert 38 of the present invention, shown in FIG. 3*b*. This central insert comprises one or more drain holes 39. This insert is sized to fit within the central opening of the circular drain strainer cap when the conduit is not inserted in the central opening. As shown in FIG. 3*c*, the central insert 38 is threaded or snapped in so that it may be screwed or snapped into or out of the central opening of the circular drain strainer cap.

The foregoing disclosure and description of the invention are illustrative and explanatory thereof, and various changes in the size, shape and materials, as well as in the details of the illustrated construction, may be made without departing from the spirit of the invention.

We claim:

1. A pipe cleaning device comprising:

a. a flexible conduit having a proximal end and a distal end;

b. a flexible connecting member slidably housed within said conduit, said connecting member comprising a proximal connecting end protruding beyond the proximal end of said conduit and a distal connecting end protruding beyond the distal end of said conduit;

c. at least two elastic strands having proximal and distal ends, the proximal end of each strand attached to the distal end of said conduit, such that when said conduit is rotated, said strands rotate, and the distal ends of each strand fastened to the distal end of said connecting member such that when said connecting member is retracted, said strands are displaced outward, and when said connecting member is not retracted, said strands are displaced in a substantially closed configuration with respect to each other; and d. a retraction handle attached to the proximal end of said connecting member such that pushing and pulling said handle results in a reciprocating motion of said connecting member.

2. The pipe cleaning device of claim 1, wherein said strands are integrally formed with said conduit.

3. The pipe cleaning device of claim 1, wherein said strands comprise an outer radial surface and an inner radial surface, the outer surface of said strands comprising a fluid absorbent material.

4. The pipe cleaning device of claim 3, wherein said strands are ribbon shaped.

5. The pipe cleaning device of claim 4, wherein the outer surface of said strands comprises an abrasive material.

6. The pipe cleaning device of claim 1, wherein said connecting member is a cable.

7. The pipe cleaning device of claim 1, wherein said connecting member is a wire.

8. The pipe cleaning device of claim 1, wherein said strands are made from a material that is detectible by x-rays or ultrasound energy.

9. The pipe cleaning device of claim 1, further comprising an expandable covering surrounding said strands.

10. The pipe cleaning device of claim 1, wherein said retraction handle comprises:

a. an outer housing sized to fit within the palm of an adult human hand;

b. an inner cavity within said outer housing sized to permit reciprocating movement of said handle and connecting member within said cavity; and c. wherein said retraction handle is attached to said connecting member, located within said cavity and protruding beyond said outer housing such that its protruding portion may be pushed or pulled by one or more fingers of an adult human hand.

11. The pipe cleaning device of claim 10, further comprising an elastic compression resistance member installed in said inner cavity and mechanically coupled to said retraction handle to provide a restoring force capable of restoring said retraction handle to a position where said connecting member is not retracted when said retraction handle is not subject to external force.

12. The pipe cleaning device of claim 11, wherein said compression resistance member is a spring.

13. The pipe cleaning device of claim 10, further comprising a coupling receptacle mounted in the top of said outer housing, such that said outer housing can be coupled to a rotational motion device.

14. The pipe cleaning device of claim 1, wherein said strands comprise a reinforcing material integrally housed within said strands.

15. A flexible pipe cleaning device comprising:

a. a flexible conduit having a proximal end and a distal end;

b. a flexible connecting member slidably housed within said conduit, said connecting member comprising a proximal connecting end protruding beyond the proximal end of said conduit and a distal connecting end protruding beyond the distal end of said conduit;

c. at least two elastic strands having proximal and distal ends, the proximal end of each strand attached to the distal end of said conduit, such that when said conduit is rotated, said strands rotate, and the distal ends of said strands fastened to the distal end of said connecting member such that when said connecting member is retracted, said strands are bowed outward, and when said connecting member is not retracted, said strands are placed in a substantially nonbowed configuration; and d. a retraction handle attached to the proximal end of said connecting member such that pushing and pulling said handle results in a reciprocating motion of said connecting member.

16. The pipe cleaning device of claim 15, further comprising reinforcing material integrally housed within said conduit and strands.

17. The pipe cleaning device of claim 15, wherein said strands are made from a material that is detectable by x-rays or ultrasound energy.

18. A pipe cleaning system comprising:

a. a flexible conduit having a proximal end and a distal end;

b. a flexible connecting member slidably housed within said conduit, said connecting member comprising a proximal connecting end protruding beyond the proximal end of said conduit and a distal connecting end protruding beyond the distal end of said conduit;

c. at least two elastic strands having proximal and distal ends, the proximal end of each strand attached to the distal end of said conduit, such that when said conduit is rotated, said strands rotate, and the distal ends of said strands fastened to the distal end of said connecting member such that when said connecting member is retracted, said strands are displaced outward, and when said connecting member is not retracted, said strands are displaced in a substantially closed configuration with respect to each other;

d. a retraction handle attached to the proximal end of said connecting member such that pushing and pulling said handle results in a reciprocating motion of said connecting member; and e. a pressure/suction source coupled to the proximal end of said conduit, said pressure/suction source capable of either injecting pressurized fluid into said conduit or creating a pressure or suction in said conduit.

19. The pipe cleaning system of claim 18, further comprising a circular drain strainer cap comprising an outer radial region and an inner radial region, said outer radial region comprising a drain hole, and said inner radial region comprising a central opening sized to permit insertion and passage of said strands and said conduit.

20. The pipe cleaning system of claim 19, wherein said drain strainer further comprises a central insert comprising a drain hole, said insert sized to fit within said central opening when said conduit is not inserted in said central opening.

* * * * *